US011426638B2

(12) United States Patent
Burch

(10) Patent No.: US 11,426,638 B2
(45) **Date of Patent: *Aug. 30, 2022**

(54) UNIVERSAL CONNECTOR FOR ADJUSTABLE GOLF CLUBS

(71) Applicant: Club-Conex LLC, Loves Park, IL (US)

(72) Inventor: Eric Burch, Rockford, IL (US)

(73) Assignee: Club-Conex LLC, Loves Park, IL (US)

( * ) Notice: Subject to any disclaimer, the term of this patent is extended or adjusted under 35 U.S.C. 154(b) by 425 days.

This patent is subject to a terminal disclaimer.

(21) Appl. No.: 15/639,303

(22) Filed: Jun. 30, 2017

(65) Prior Publication Data

US 2017/0296882 A1 Oct. 19, 2017

Related U.S. Application Data

(63) Continuation of application No. 14/226,519, filed on Mar. 26, 2014, now Pat. No. 9,724,571.

(51) Int. Cl.
*A63B 53/02* (2015.01)

(52) U.S. Cl.
CPC ..... *A63B 53/02* (2013.01); *A63B 2225/09* (2013.01); *Y10T 29/49826* (2015.01)

(58) Field of Classification Search
CPC ..... A63B 53/02; A63B 2053/021; A63B 2053/022; A63B 2053/023;
(Continued)

(56) References Cited

U.S. PATENT DOCUMENTS 682,960 A 9/1901 Slazenger
1,543,636 A 6/1925 Williamson
(Continued)

FOREIGN PATENT DOCUMENTS

GB 325677 2/1930
JP 2008245669 A 10/2008
(Continued)

OTHER PUBLICATIONS http://www.clubconex.com/images/FUSE-FIT_Hosel_Adapter_Installation_REV1.pdf; date available online Dec. 2010; 1 page.
(Continued)

*Primary Examiner* — Sebastiano Passaniti
(74) *Attorney, Agent, or Firm* — Reinhart Boerner Van Deuren P.C.

(57) ABSTRACT

A universal connector for an adjustable golf club is provided. Such a universal connector includes a first member having a head portion and a body portion and having a bore for receiving a terminal end of a shaft. The connector also includes a second member having a bore for receiving a portion of the first member therein. The first member includes a first anti-rotational member and the second member includes a second anti-rotational member. The first and second anti-rotational members are engageable with one another to prevent relative rotation of the first member relative to the second member about a longitudinal axis of the connector. The second member includes a third anti-rotational member, the third anti-rotational member configured to mate with an anti-rotational member of the golf club head to prevent relative rotation of the second member relative to the head.

21 Claims, 4 Drawing Sheets

(58) Field of Classification Search
CPC ..... A63B 2053/025; A63B 2053/026; A63B 2053/027; A63B 2225/09; Y10T 29/49826
USPC ..... 473/305–315
See application file for complete search history.

(56) References Cited

U.S. PATENT DOCUMENTS

| | | | | |
|---|---|---|---|---|
| 1,565,069 | A | 12/1925 | Edwards | |
| 1,585,907 | A | 5/1926 | Miller | |
| 2,231,847 | A | 2/1941 | Dickson et al. | |
| 2,463,053 | A | 3/1949 | Pritchard | |
| 2,464,850 | A | 3/1949 | Crawshaw | |
| 3,170,691 | A | 2/1965 | Pritchard | |
| 3,524,646 | A | 8/1970 | Wheeler | |
| 3,947,041 | A | 3/1976 | Barber | |
| 4,340,227 | A | 7/1982 | Dopkowski | |
| 5,137,275 | A | 8/1992 | Son | |
| 5,275,408 | A | 1/1994 | Desbiolles et al. | |
| 5,390,921 | A | 2/1995 | De Ruyter | |
| 5,395,109 | A | 3/1995 | Fenton, Jr. | |
| 5,429,358 | A | 7/1995 | Rigal et al. | |
| 5,588,921 | A | 12/1996 | Parsick | |
| 5,863,260 | A | 1/1999 | Butler, Jr. et al. | |
| 5,951,411 | A | 9/1999 | Wood et al. | |
| 5,971,865 | A | 10/1999 | Shenoha et al. | |
| 6,039,659 | A | 3/2000 | Hamm | |
| 6,343,999 | B1 | 2/2002 | Murtland et al. | |
| D477,487 | S | 7/2003 | Chaney et al. | |
| D477,955 | S | 8/2003 | Chaney et al. | |
| D478,140 | S | 8/2003 | Burrows | |
| D478,233 | S | 8/2003 | Chaney et al. | |
| D478,951 | S | 8/2003 | Burrows | |
| D482,087 | S | 11/2003 | Burrows | |
| D482,089 | S | 11/2003 | Burrows | |
| D482,090 | S | 11/2003 | Burrows | |
| D482,094 | S | 11/2003 | Burrows | |
| D482,419 | S | 11/2003 | Burrows | |
| D482,420 | S | 11/2003 | Burrows | |
| D483,826 | S | 12/2003 | Burrows | |
| D484,208 | S | 12/2003 | Burrows | |
| 6,692,375 | B2 | 2/2004 | Abe | |
| 6,746,341 | B1 | 6/2004 | Hamric, Jr. et al. | |
| 6,764,413 | B2 | 7/2004 | Ho | |
| 6,797,106 | B2 | 9/2004 | Lenhof et al. | |
| 6,890,269 | B2 | 5/2005 | Burrows | |
| 7,083,529 | B2 | 8/2006 | Cackett et al. | |
| 7,163,465 | B2 | 1/2007 | Edel | |
| 7,207,897 | B2 | 4/2007 | Burch et al. | |
| 7,300,359 | B2 | 11/2007 | Hocknell et al. | |
| 7,326,126 | B2 | 2/2008 | Holt et al. | |
| 7,335,113 | B2 | 2/2008 | Hocknell et al. | |
| 7,427,239 | B2 | 9/2008 | Hocknell et al. | |
| 7,704,158 | B2 | 4/2010 | Burrows | |
| 7,789,766 | B2 | 9/2010 | Morris et al. | |
| 7,789,769 | B2 | 9/2010 | Sugimoto | |
| 7,819,754 | B2 | 10/2010 | Evans et al. | |
| 7,857,709 | B2 | 12/2010 | Burch | |
| 8,046,899 | B2 | 11/2011 | Burch | |
| 8,057,320 | B2 | 11/2011 | Bennett et al. | |
| 8,142,306 | B2 | 3/2012 | De La Cruz et al. | |
| 8,235,837 | B2 | 8/2012 | Bennett et al. | |
| 8,562,454 | B2 | 10/2013 | Burch | |
| 8,632,417 | B2 | 1/2014 | Sander et al. | |
| 9,050,506 | B2 * | 6/2015 | Boyd | A63B 53/02 |
| 9,339,700 | B2 | 5/2016 | Oyama | |
| 2003/0050132 | A1 | 3/2003 | Wilbur | |
| 2003/0153398 | A1 | 8/2003 | Tseng | |
| 2003/0181255 | A1 | 9/2003 | Ho | |
| 2004/0018886 | A1 | 1/2004 | Burrows | |
| 2004/0018887 | A1 | 1/2004 | Burrows | |
| 2005/0176521 | A1 | 8/2005 | Burch et al. | |
| 2007/0017334 | A1 | 1/2007 | Hebestreit et al. | |
| 2007/0173344 | A1 | 7/2007 | Burch | |
| 2008/0254908 | A1 | 10/2008 | Bennett et al. | |
| 2008/0254909 | A1 | 10/2008 | Callinan et al. | |
| 2008/0293510 | A1 | 11/2008 | Yamamoto | |
| 2009/0181792 | A1 | 7/2009 | Burch | |
| 2009/0247316 | A1 | 10/2009 | De La Cruz et al. | |
| 2010/0197423 | A1 | 8/2010 | Thomas et al. | |
| 2011/0256951 | A1 | 10/2011 | Soracco et al. | |
| 2012/0231896 | A1 | 9/2012 | Seluga et al. | |
| 2013/0184098 | A1 | 7/2013 | Boyd et al. | |
| 2013/0281224 | A1 | 10/2013 | Zabala Scharpp | |
| 2014/0121032 | A1 * | 5/2014 | Stites | A63B 53/00 473/244 |
| 2014/0187345 | A1 | 7/2014 | Beach et al. | |
| 2015/0031469 | A1 * | 1/2015 | Yamasawa | A63B 53/02 473/307 |
| 2015/0151170 | A1 * | 6/2015 | Oyama | A63B 53/02 473/307 |

FOREIGN PATENT DOCUMENTS

| | | | |
|---|---|---|---|
| WO | WO 2004/000424 | A1 | 12/2003 |
| WO | WO 2004/000425 | A1 | 12/2003 |
| WO | WO 2004/009181 | A2 | 1/2004 |
| WO | WO 2004/009186 | A1 | 1/2004 |

OTHER PUBLICATIONS http://www.clubconex.com/images/FUSE-FIT_Shaft_Adapter_Installation_REV.pdf; date available online Dec. 2010; 1 page.
2004 PGA Merchandise Show News (magazine); Jan. 31, 2004; 3 pages; Publisher: GGRW Inc., Norwalk, CT.
Henry-Griffitts, Inc.; HG Timeline (internet reference); Feb. 20, 2006; 2 pages; www.henry-griffitts.com.
Henry-Griffitts, Inc.; Golf Training Center (internet reference); Feb. 20, 2006; 1 page; www.henry-griffitts.com.
Henry-Griffitts, Inc.; True Temper and Henry-Griffitts Team Up to Produce Breakthrough Clubfitting System (internet reference); Feb. 20, 2006; 1 page; www.truetemper.com.
U.S. Appl. No. 14/226,519, filed Mar. 26, 2014.

* cited by examiner

UNIVERSAL CONNECTOR FOR ADJUSTABLE GOLF CLUBS

CROSS-REFERENCE TO RELATED PATENT APPLICATIONS

This patent application is a continuation of co-pending U.S. patent application Ser. No. 14/226,519, filed Mar. 26, 2014, the entire teachings and disclosure of which are incorporated herein by reference thereto.

FIELD OF THE INVENTION

This invention generally relates to golf equipment and more specifically to connectors for interchangeable golf club heads and golf club shafts.

BACKGROUND OF THE INVENTION

The typical way to connect a golf club shaft and a golf club head is to epoxy the tip end of the golf club shaft into a bore formed within the hosel portion of the golf club head. Many golf shops offer a broad range of exotic shafts and club heads to meet the standards of today's demanding golfer.

To facilitate the ease in which various combinations of shafts and heads may be evaluated by the golfer, some golf equipment makers, such as Adams Golf, Callaway, Cobra, Cleveland, Mizuno, Nike, Taylor Made, Titleist and many others have devised connectors that rapidly secure a shaft and a club head together thereby making such clubs are referred to as "adjustable" clubs. Because these connectors are releasable, if the customer doesn't like the existing shaft and head combination the connector is simply released and a different shaft and head combination is secured for evaluation by the golfer.

In such adjustable club configurations, the connector used thereby is typically mounted on the club head and contains brand specific mounting features thereon.

In recent years there has been an increase industry wide of such connectors. As a result, each manufacturer that utilizes adjustable connectors has elected to employ a proprietary connector configuration that is not interchangeable with other brands of equipment. Some have "squared keyways", "hexagon keyways", "splines", etc., and as a result. The result of such a configuration limits a user to only interchanging club heads and club shafts that are of the same brand. However, there are many instances where a user may prefer one brand of club shafts that is not the same brand as that user's preferred brand of club heads. In such instances, such users have heretofore been prevented from utilizing such a preferred combination because the brand specific connector portion situated on the club head will not mate with the differing brand specific connector portion situated on the club shaft. Accordingly, there is a need in the art for a universal connector for adjustable golf clubs.

The invention provides such a universal. These and other advantages of the invention, as well as additional inventive features, will be apparent from the description of the invention provided herein.

BRIEF SUMMARY OF THE INVENTION

In one aspect, the invention provides a universal connector for connecting a golf club head having a hosel and a golf club shaft, regardless of the fact that the golf club head and shaft are of the adjustable construction and utilize a brand specific connector arrangement. Such a universal connector includes a first member having a head portion and a body portion and having a bore for receiving a terminal end of a shaft. The connector also includes a second member having a bore for receiving a portion of the first member therein. The second member has a head portion and a body portion. The body portion is sized to be received within a bore of the hosel. The first member includes a first anti-rotational member and the second member includes a second anti-rotational member. The first and second anti-rotational members are engageable with one another to prevent relative rotation of the first member relative to the second member about a longitudinal axis of the connector. The second member includes a third anti-rotational member, the third anti-rotational member configured to mate with an anti-rotational member of the golf club head to prevent relative rotation of the second member relative to the head.

In another aspect, the invention provides a universal connector for connecting a golf club head having a hosel and a golf club shaft, which such a connector providing a reduced part count and lower cost alternative than current designs. The connector includes a first member having a first anti-rotational member formed thereon and configured for connection to the shaft. The connector also includes a second member having a second anti-rotational member formed thereon and configured for being received within a bore of the hosel, the first and second anti-rotational members engageable with one another. The first member includes a threaded bore configured for receipt of a mounting screw extending through a portion of the club head, wherein tightening of the screw axially biases the first and second members together within the hosel.

In certain embodiments according to the foregoing aspects, the first anti-rotational member is a plurality of downwardly extending teeth formed at an axial extent of the head portion of the first member. The second anti-rotational member is a plurality of upwardly extending teeth formed at an axial extent of the head portion of the second member. The downwardly extending teeth are received within spaces formed between the upwardly extending teeth to rotational fix the first member relative to the second member.

In certain embodiments according to the foregoing aspects, the head portion of the first member has a maximum outer diameter which is greater than a maximum outer diameter of the body portion of the first member. The body portion of the first member includes a transition region and an extension region. A first axial abutment surface is formed at an interface of the transition region and the extension region. A second axial abutment surface is formed along the bore of the second member and is configured to axially abut the first axial abutment surface.

In certain embodiments according to these aspects, the third anti-rotational member is selected from the group consisting of: a plurality of radially outwardly extending ribs formed at an end of the body portion of the first member, a plurality of downwardly extending teeth formed at an interface of the head portion and the body portion of the first member, a plurality of radially outwardly facing facets formed at the interface between the head portion and the body portion of the first member, a plurality of downwardly extending teeth formed at an axial extent of the head portion of the first member, a plurality of outwardly extending ribs formed along an outer periphery of the body portion of the first member between the head portion and an end of the body portion.

In yet another aspect, the invention provides a method for installing a universal connector on a golf club having a head with a hosel and a shaft. The method includes inserting a portion of the shaft into a bore of a first member of the connector. The method also includes inserting a portion of a second member of the connector into a bore of the hosel. The method also includes inserting a portion of the first member into a bore of the second member such that a portion of the first member and a the portion of the shaft received in the bore of the first member are positioned within the bore of the second member. The method also includes rotationally fixing the second member relative to the club head and rotationally fixing the first member relative to the second member.

The method can also include securing the portion of the shaft within the bore of the first member using an adhesive.

In certain embodiments, the method can also include rotationally fixing the first member relative to the second member by bringing a first anti-rotational member of the first member into engagement with a second anti-rotational member of the second member.

In certain embodiments, the method can also include rotationally fixing the second member relative to the club head by bringing a third anti-rotational member of the second member into engagement with a club head anti-rotational member formed on the hosel of the club head.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Turning now to the illustrations, several embodiments of a connector for an adjustable golf club are illustrated. As will be explained in greater detail below, these embodiments overcome existing problems in the art discussed above by providing a universal connector that will readily work with a variety of differing brand specific connectors. Indeed, embodiments of the universal connector described herein allow a user to connect a club shaft of one brand with a club head of another brand, despite the fact that the originally provided connector componentry for the club shaft and the club head do not mate with one another.

Figure 1:
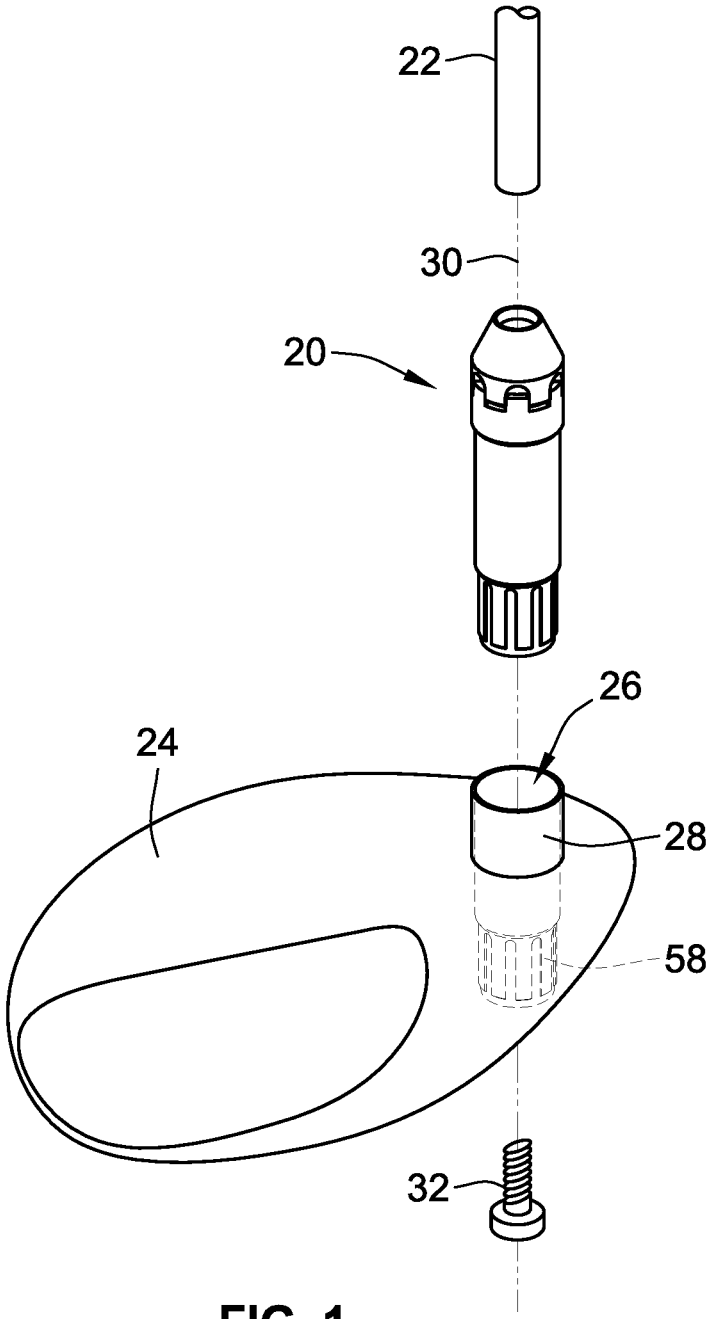
FIG. 1 is a perspective view of one embodiment of a universal connector according to the teachings of the invention shown in an assembly view with a golf club head and a partially shown golf club shaft.

Turning now to FIG. 1, a first embodiment of a connector 20 is illustrated. Connector 20 connects a golf club shaft 22 to a golf club head 24. As is known in the art, club head 24 includes a hosel 28 extending therefrom which defines a bore 26 extending into club head 24. A portion of connector 20 is received within bore 26. Another portion of connector 20 is secured to club shaft 22. The portion of connector 20 which is received in club head 24 is secured to club head 24 using a mounting fastener 32. Club head 24 is generally illustrated as an adjustable club head in that it includes brand specific features in the area of hosel 28 for receiving a portion of a brand specific connector. As will be explained in greater detail below, embodiments of the invention described herein provide a connector which includes a portion thereof designed to mate with the aforementioned brand specific features of the connector originally provided with club head 24. This portion of the connector described herein also provides a universal interface such that a common other portion of connector 20 may be utilized on club shaft 22 so that any club shaft 22 utilizing this other portion of the connector described herein will mate with the portion of the connector received in club head 24, regardless of the fact that club shaft 22 and club head 24 are of different brands.

Figure 2:
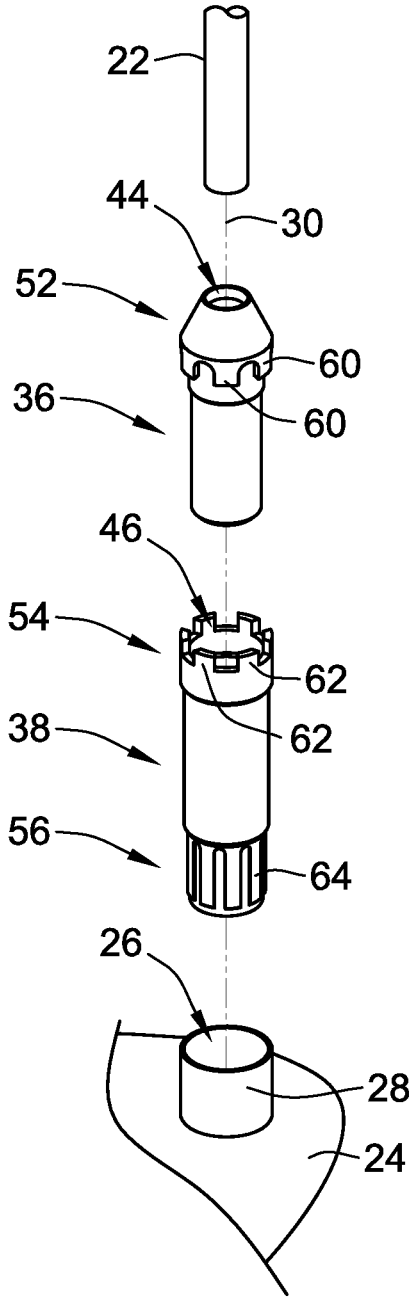
FIG. 2 is a perspective exploded view of the embodiment shown in FIG. 1, showing first and second members of the connector.

With specific reference now to FIG. 2, connector 20 includes a first member 36 and a second member 28. First member 36 includes a bore 44 which receives a portion of club shaft 22. Second member 38 also includes a bore 46 which receives a portion of first member 36, as well as some extent of club shaft 22 which is received in first member 36.

First member 36 may be readily secured to club shaft 22 through the use of adhesives. Additionally, first member 36 may also include alignment indicia thereon for rotationally aligning first member 36 relative to connector axis 30 relative to club shaft 22.

First member 36 also includes a first anti-rotational member 52. Second member 38 includes a second anti-rotational member 54. The first and second anti-rotational members 52, 54 engage one another in the fully assembled state of connector 20 to prevent rotation of first member 36 relative to second member 38 and vice versa.

Additionally, second member 38 also includes a third anti-rotational member 56 which mates with a club head anti-rotational member 58 disposed on or within the hosel 28. Third anti-rotational member 56 and club head anti-rotational member 58 engage one another to prevent rotation of second member 38 relative to club head 24 rotationally about connector axis 30. As will be described in greater detail below, club head anti-rotational member 58 will vary depending upon the specific brand of club head. As such, the particular structural attributes of second member 38 will vary depending upon the particular club head 24. However, second member 38 will always provide a universal second anti-rotational member 54 and bore 46 to accommodate a single embodiment of a first member 36. As a result, a user may utilize the same first member with differing second members. As a practical result, a user may utilize a single set of preferred golf club shafts 22 which incorporate first member 36 with a plurality of club heads 24 of differing brands. All that is required to achieve this functionality is the utilization of the brand specific second member 38, and more particularly its specific configuration of a third anti-rotational member 56 designed to mate with the particular configuration of a club head anti-rotational member 58 of club head 24.

Indeed, first anti-rotational member 52 of first member 36 is embodied by a plurality of downwardly extending teeth 60 as shown in FIG. 2. Those skilled in the art will readily recognize that the particular number of teeth shown should be taken by way of example only, as the number of teeth 60 may be varied. Second anti-rotational member 54 of second member 38 is defined by a plurality of upwardly extending teeth 62 which mate with downwardly extending teeth 60. These upwardly extending teeth 62 are common across all embodiments of second member 38, and thus all of these embodiments readily mate with the illustrated embodiment of first member 36.

In the particular embodiment illustrated, third anti-rotational member 56 is embodied by a plurality of radially outwardly extending ribs 64. These ribs 64 mate with radially inwardly extending ribs formed along the interior surface of bore 26 of hosel 28 which form the club head anti-rotational member. The engagement between the aforementioned ribs prevents rotation of second member 38 relative to club head 24 about connector axis 30.

Figure 3:
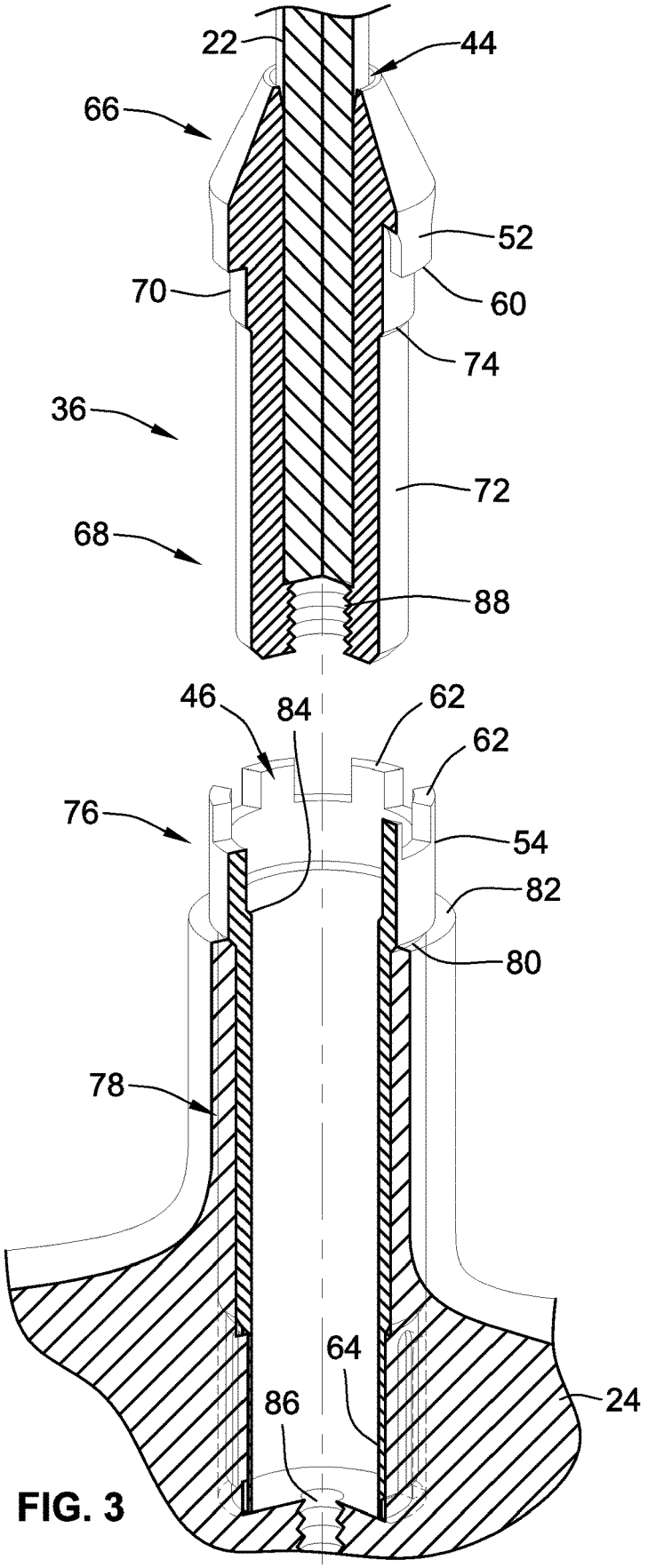
FIG. 3 is a perspective exploded view of the embodiment shown in FIG. 1 illustrated in cross section.

Turning now to FIG. 3, the structural attributes of first and second members 36, 38 are described in greater detail. As can be seen in this view, a portion of shaft 22 is received within bore 44. Shaft 22 extends into bore 44 until it positively engages a bottom of bore 44, however, other depths of insertion may be utilized. As described above, shaft 22 may be secured within bore 44 uses an adhesive or any other known method. First member 36 includes a head portion 66 and a body portion 68 which extends away from head portion 66. Body portion 68 includes a transition region 70 and an extension region 72. As shown, head portion 66 has a maximum outer diameter which is greater than a maximum outer diameter of body portion 68. Additionally, transition region 70 has a greater maximum outer diameter than a maximum outer diameter of extension region 72. A first axial abutment surface 74 is formed at the interface between transition region 70 and extension region 72. This first axial abutment surface 74 axially abuts a second axial abutment surface 84 formed within the bore 46 of second member 38 when connector 20 is completely assembled.

Second member 38 includes a head portion 76 and a body portion 78. A seat 80 is defined at the interface of head portion 76 and body portion 78. Seat 80 engages a top surface 82 of hosel 28 when second member 38 is fully positioned within bore 26 of hosel 28. As can also be seen in FIG. 3, a bottom of club head 24 includes a threaded hole 86 which receives fastener 32 shown in FIG. 1. This fastener 32 threadably extends through threaded hole 86 and engages a threaded hole 88 of first member 38.

As shown in FIG. 3, threaded hole 88 is illustrated as communicating with bore 44. However, in other embodiments, threaded hole 88 may be a blind threaded hole which does not communicate with bore 44. When first member 36 is fully positioned within second member 38 as shown in FIG. 1, fastener 32 extends through threaded hole 86 and threadably engages threaded hole 88 of first member 36. As fastener 32 is tightened, first member 36 is drawn downward along axis 30 to bring first and second axial abutment surfaces 74, 84 into engagement. Continued tightening of fastener 32 thus biases first and second members 36, 38 downwardly along connector axis 30 to bring seat 80 into engagement with top surface 82 of hosel 26. The foregoing tightening of fastener 32 thus axially connects first and second members 36, 38 and also club head 24 to club shaft 22. As discussed above, teeth 60, 62 engage one another to rotationally fix first connector 36 relative to second connector 38 and thus club head 24 as well. As also discussed above, ribs 64 engage club head anti-rotational feature 58 to rotationally fix second member 38 relative to club head 24, and thus also rotationally fix first member 36 and club shaft 22 relative to club head 24.

FIGS. 4-11 show various alternative embodiments of second member which are designed to mate with the brand specific mating features of various adjustable club heads. As can readily be seen from inspection of these figures, and as introduced above, they all include a common second anti-rotational member which is the same as second anti-rotational member described above relative to FIGS. 1-3. However, each of the embodiments of second member shown herein include a different third anti-rotational member which is specific to the specific brand of club head which it will be utilized with.

Figure 4:
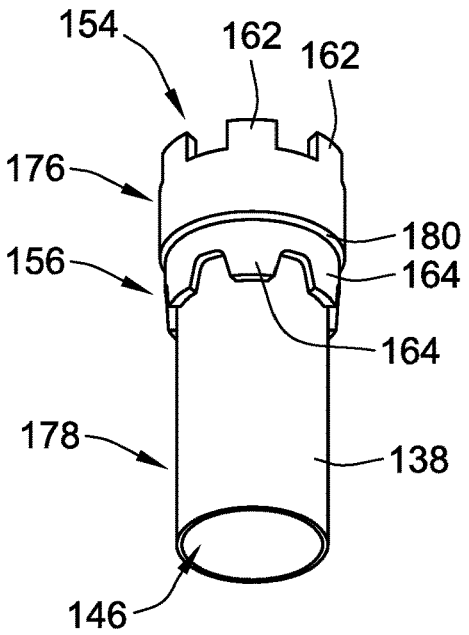
FIGS. 4-5 are perspective views of another embodiment of a second member of a connector according to the teachings of the invention.
Figure 5:
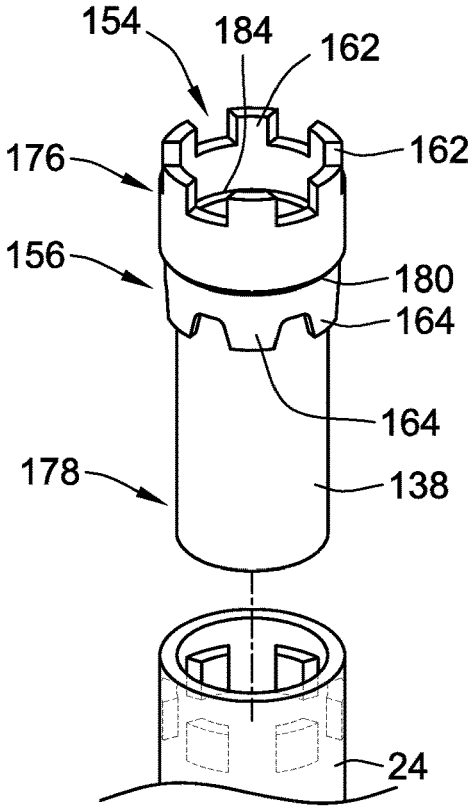

Indeed, with reference to FIGS. 4-5, a second embodiment of a second member 138 is illustrated. This second member 138 includes a head portion 176 and a body portion 178. Second member 138 also includes second anti-rotational member 154 which includes a plurality of teeth 162 which are identical to teeth 62 described above. Additionally, second member 138 also includes a seat 180 which functions in the same manner as seat 80 described above. However, third anti-rotational member 156 in this embodiment is different than that described above. Indeed, third anti-rotational member 156 includes a plurality of downwardly extending teeth 164. These downwardly extending teeth 164 are arranged to engage corresponding projections within an interior bore of a hosel. This engagement rotational fixes second member 138 within such a hosel.

As can be seen in FIGS. 4-5, third anti-rotational member 156 is formed at the interface between head portion 176 and body portion 178. Contrast this with what is shown in FIGS. 1-3, wherein the third anti-rotational member 56 is formed at an end of body portion 76 of second member 38. Second member 138 also includes a second axial abutment surface 184 that functions in the same manner as second axial abutment surface 84 described above.

Figure 6:
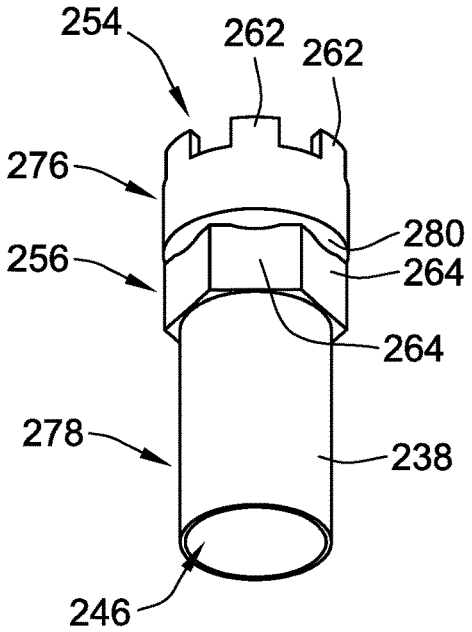
FIGS. 6-7 are perspective views of another embodiment of a second member of a connector according to the teachings of the invention.
Figure 7:
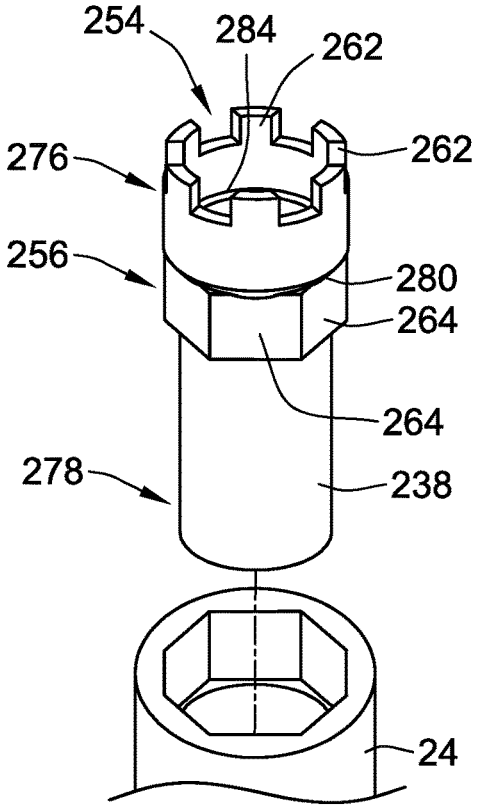

A third embodiment of a second connector 238 is illustrated in FIGS. 6-7. This embodiment also includes a head portion 276 and a body portion 278. This embodiment also includes a second anti-rotational member 254 defined by a plurality of teeth 262 which are identical to the second anti-rotational member as described above. A seat 280 is also formed at the interface between head portion 276 and body portion 278 and functions in the same manner as the seats described above.

However, in this embodiment, third anti-rotational member 256 takes the form of a plurality of facets which generally resemble the outer periphery of a nut. These facets 264 are designed to mate with facets formed within an interior bore of a club head such that rotation of second member 238 relative to club head is prevented. As can also be seen from inspection of FIGS. 6 and 7, third anti-rotational member 256 is formed at the interface between head portion 276 and body portion 278 in a similar manner as that described above relative to FIGS. 4-5. As can also be seen in FIGS. 6-7, second member 238 includes a bore 246 for receipt of first member 38 in the manner described above. Second member 238 also includes a second axial abutment surface 284 that functions in the same manner as second axial abutment surface 84 described above.

Figure 8:
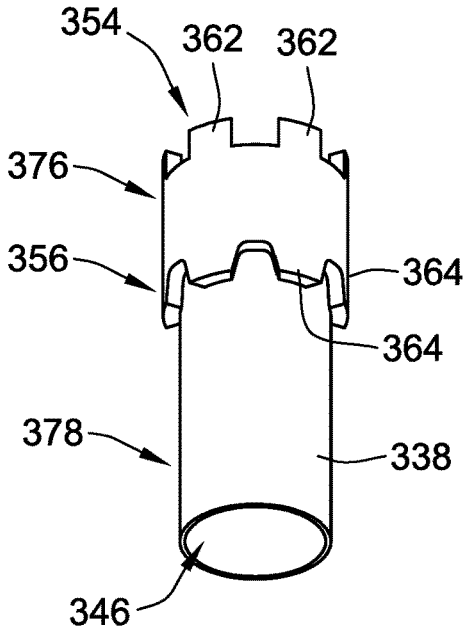
FIGS. 8-9 are perspective views of another embodiment of a second member of a connector according to the teachings of the invention.
Figure 9:
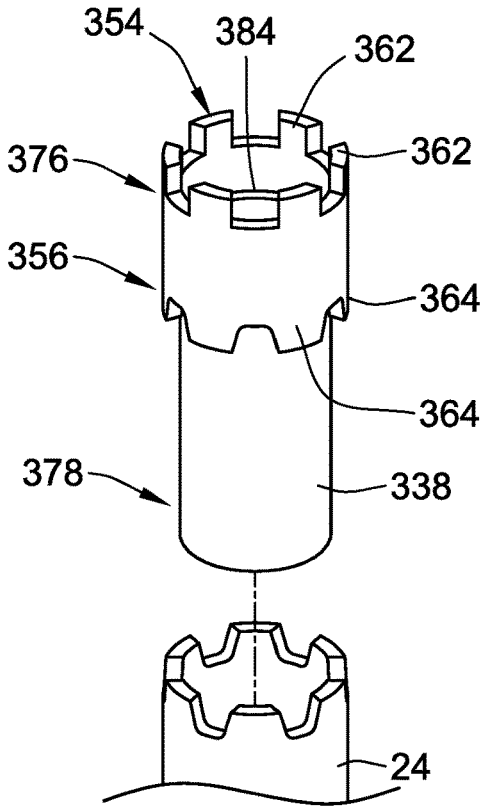

Another embodiment of a second member 338 is shown in FIGS. 8-9. This embodiment also includes a head portion 376 and a body portion 378. A second anti-rotational member 354 is formed thereon which includes a plurality of teeth 362. Second anti-rotational member 354 is identical to the second anti-rotational members described above.

However, second member 338 includes a third anti-rotational member 356 formed directly on head portion 376. This third anti-rotational member 356 includes a plurality of downwardly extending teeth 364. These downwardly extending teeth 364 mate with corresponding upwardly extending teeth formed adjacent a top surface of a hosel. These teeth engage one another to prevent relative rotation of second member 338 relative to the club head. Also, second member 338 includes a bore 346 for receipt of first member 30 in the same manner as described above. Second member 338 also includes a second axial abutment surface 384 that functions in the same manner as second axial abutment surface 84 described above.

Figure 10:
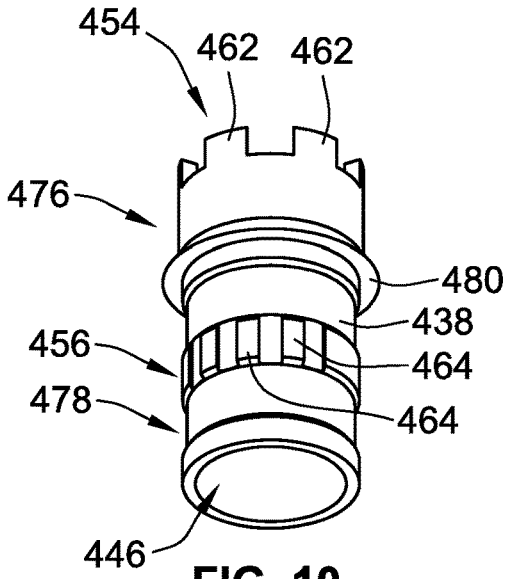
FIGS. 10-11 are perspective views of another embodiment of a second member of a connector according to the teachings of the invention.
Figure 11:
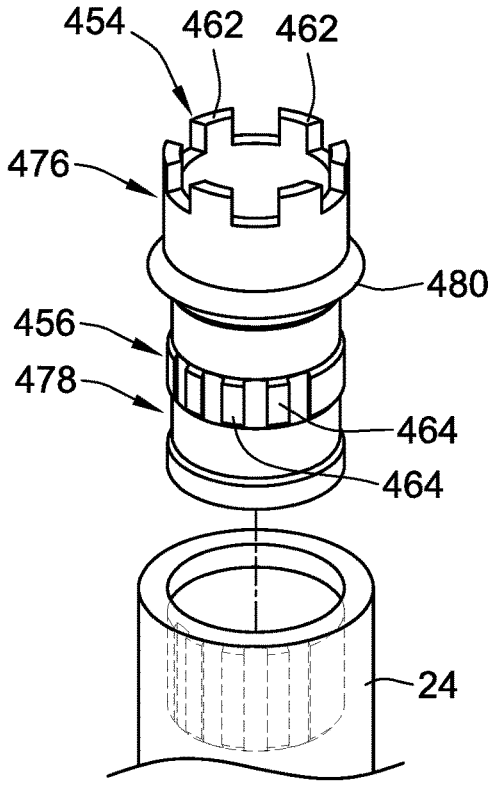

FIGS. 10-11 show a fifth embodiment of a second member 438. This embodiment includes a head portion 476 and a body portion 478. This embodiment also includes a second anti-rotational member 454 which includes a plurality of upwardly extending teeth 462 which are identical to the second anti-rotational members described above. Second member 438 also includes a seat 480 which functions in the same manner as the seats described above.

However, third anti-rotational member 456 of second member 438 is formed on body portion 478 and between head portion 476 and an end of body portion 478 along the outer periphery of body portion 478. This embodiment of a third anti-rotational member 456 includes a plurality of outwardly extending ribs 464. This plurality of outwardly extending ribs engages a plurality of inwardly extending ribs formed along an interior surface of a hosel of a club head to thereby prevent rotation of second member 438 relative to the club head. This embodiment also includes a bore 446 which receives first connector 38 in the same manner as described above. Although not illustrated, second member 438 may also include a second axial abutment surface that functions in the same manner as second axial abutment surface 84 described above.

As will be understood from the foregoing, each of the embodiments shown in FIGS. 4-11 are designed to mate with a specific adjustable club head based upon the brand thereof. However, each of these embodiments will readily mate with the common first member 36 shown in FIGS. 1-3. As a result, a user may utilize any desired shaft which incorporates first member 36 with any of the embodiments of second members described herein. As a result, a user is no longer locked into a single brand of adjustable club heads and adjustable club shafts, but instead can readily interchange one brand of an adjustable club head with a different brand of a club shaft.

Those skilled in the art will readily recognize that the installation process for these varying embodiments of second members is essentially the same as that described above relative to FIG. 3. Indeed, the second member is inserted into the hosel and arranged such that its third anti-rotational member mates with the club head anti-rotational member of the club head. The first member 38 is inserted therein. A fastener 32 is inserted through the threaded hole 86 of the club head 24 and tightened to engage the threaded hole 88 of first member 36. Continue tightening of fastener 32 axially biases the first and second members along their connector axis until members are fully axially located. The first and second anti-rotational members engage one another to prevent relative rotation of the first member relative to the second member, and the third anti-rotational member engages the club head anti-rotational member to prevent relative rotation between these components.

As a result, a user need only outfit a variety of clubs with a common style of first connector 36 as shown in FIGS. 1-3. Thereafter, and depending upon the particular style of adjustable club head they owned, they select the appropriate second connector member. Each one of these variety of shafts incorporating first member 36 will readily mate with the particular club head which receives the brand specific second member described herein.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A universal connector system for connecting a golf club head having a hosel and a golf club shaft, the connector comprising:

a first member having a head portion and a body portion and having a bore for receiving a terminal end of a shaft, the first member formed as a single piece, and wherein the first member defines an axial upper most extent of the universal connector system;

at least one second member, the at least one second member having a head portion and a body portion, the body portion configured to mate with the hosel, wherein the at least one second member is matable with the first member to connect the golf club head to the golf club shaft, the at least one second member formed as a single piece;

wherein the first member includes a first anti-rotational member in the form of a plurality of downwardly facing teeth and the at least one second member includes a second anti-rotational member in the form of a plurality of upwardly facing teeth formed on the head portion thereof, the first and second anti-rotational members engageable with one another to prevent relative rotation of the first member relative to the second member about a longitudinal axis of the connector, the first and second anti-rotational members forming a mating interface which is exposed on an exterior radially outer facing surface of the universal connector system; and wherein the at least one second member includes a third anti-rotational member formed on the body portion of the at least one second member axially below the second anti-rotational member, the third anti-rotational member configured to mate with an anti-rotational member of the golf club head to prevent relative rotation of the second member relative to the head, wherein the first member includes a threaded bore for receipt of a one-piece mounting screw which abuts an exterior of the club head and threads directly into the first member to axially bias the first member into the second member;

wherein the third anti-rotational member of the second member being selected from the group consisting of:

a plurality of radially outwardly extending ribs that are axially offset from the head portion of the second member such that the body portion of the second member forms a cylindrical region between the plurality of radially outwardly extending ribs and the head portion of the second member, the cylindrical region having an outer diameter that is smaller than an outer diameter of the head portion of the second member;

a plurality of downwardly extending teeth that have an outer diameter that is smaller than an outer diameter of the head portion of the second member and the outer diameter of the plurality of downwardly extending teeth is greater than an outer diameter of the body portion of the second member;

a plurality of radially outwardly facing facets that are radially outward facing flat faces formed at the interface between the head portion and the body portion of the second member;

a plurality of outwardly extending ribs formed along an outer periphery of the body portion of the second member between the head portion and an end of the body portion, the plurality of outwardly extending ribs have an outer diameter that is smaller than an outer diameter of the head portion of the second member; and a plurality of members in the form of teeth, ribs or facets that have an outer diameter that is smaller than an outer diameter of the head portion of the second member.

2. The system of claim 1, wherein the plurality of downwardly extending teeth are formed at an axial extent of the head portion of the first member.

3. The system of claim 2, wherein the upwardly extending teeth formed at an axial extent of the head portion of the second member.

4. The system of claim 3, wherein the downwardly extending teeth are received within spaces formed between the upwardly extending teeth to rotational fix the first member relative to the at least one second member.

5. The system of claim 1, wherein the head portion of the first member has a maximum outer diameter which is greater than a maximum outer diameter of the body portion of the first member.

6. The system of claim 5, wherein the body portion of the first member includes a transition region and an extension region, wherein a first axial abutment surface is formed at an interface of the transition region and the extension region.

7. The system of claim 6, wherein a second axial abutment surface is formed along the bore of the second member and is configured to axially abut the first axial abutment surface.

8. The system of claim 1, wherein the third anti-rotational member of the second member is the plurality of downwardly extending teeth that have the outer diameter that is smaller than the outer diameter of the head portion of the second member and the outer diameter of the plurality of downwardly extending teeth is greater than an outer diameter of the body portion of the second member, the plurality of downwardly extending teeth being formed at an interface of the head portion and the body portion of the second member.

9. The system of claim 1, wherein the third anti-rotational member of the second member is the plurality of downwardly extending teeth that have the outer diameter that is smaller than the outer diameter of the head portion of the second member and the outer diameter of plurality of downwardly extending teeth is greater than an outer diameter of the body portion, a cylindrical region is positioned axially between the plurality of downwardly extending teeth and the head portion of the second member, the cylindrical region having an outer diameter that is greater than the outer diameter of the body portion and is smaller than the outer diameter of the head portion.

10. The system of claim 1, wherein the third anti-rotation member of the second member is the plurality of radially outwardly extending ribs that are axially offset from the head portion of the second member such that the body portion of the second member forms the cylindrical region between the plurality of radially outwardly extending ribs and the head portion of the second member, the cylindrical region having the outer diameter that is smaller than the outer diameter of the head portion of the second member, the plurality of radially outwardly extending ribs are formed proximate an end of the body portion of the second member.

11. The system of claim 1, wherein the third anti-rotation member of the second member is the plurality of radially outwardly extending ribs that are axially offset from the head portion of the second member such that the body portion of the second member forms the cylindrical region between the plurality of radially outwardly extending ribs and the head portion of the second member, the cylindrical region having the outer diameter that is smaller than the outer diameter of the head portion of the second member, and the plurality of radially outwardly extending ribs have an outer diameter that is smaller than the outer diameter of the cylindrical region.

12. The system of claim 1, wherein the third anti-rotation member of the second member is the plurality of members in the form of teeth, ribs or facets that have the outer diameter that is smaller than the outer diameter of the head portion of the second member, and the plurality of members do not extend axially entirely to the end of the body portion of the second member.

13. The system of claim 1, wherein the third anti-rotation member of the second member is the plurality of radially outwardly facing flat faces formed at the interface between the head portion and the body portion of the second member, a minimum radial dimension of the outwardly facing flat faces is smaller than the maximum radial dimension of the head portion of the second member.

14. The system of claim 1, wherein the third anti-rotation member is sized and configured to be fully received in the hosel of the golf club head such that the entirety of the third anti-rotation member is fully hidden within the hosel of the golf club and is not visible.

15. A universal connector system for connecting a golf club head having a hosel and a golf club shaft, the connector comprising:

a single piece first member having a first anti-rotational member formed thereon and configured for connection to the shaft;

at least one second member having a second anti-rotational member formed thereon and configured for mating with the hosel, the first anti-rotational member engageable with the second anti-rotational member to connect the golf club head to the golf club shaft, wherein the at least one second member is formed as a single piece, the at least one second member including a head portion, a body portion and a third anti-rotational member, the third anti-rotational member being selected from the group consisting of:

a plurality of radially outwardly extending ribs that are axially offset from the head portion of the second member such that the body portion of the second member forms a cylindrical region between the plurality of radially outwardly extending ribs and the head portion of the second member, the cylindrical region having an outer diameter that is smaller than an outer diameter of the head portion of the second member;

a plurality of downwardly extending teeth that have an outer diameter that is smaller than an outer diameter of the head portion of the second member and the outer diameter of the plurality of downwardly extending teeth is greater than an outer diameter of the body portion of the second member;

a plurality of radially outwardly facing facets that are radially outward facing flat faces formed at the interface between the head portion and the body portion of the second member;

a plurality of outwardly extending ribs formed along an outer periphery of the body portion of the second member between the head portion and an end of the body portion, the plurality of outwardly extending ribs have an outer diameter that is smaller than an outer diameter of the head portion of the second member; and a plurality of members in the form of teeth, ribs or facets that have an outer diameter that is smaller than an outer diameter of the head portion of the second member;

wherein the first member includes a threaded bore configured for receipt of a mounting screw extending through a portion of the club head and which threads directly into the threaded bore, wherein tightening of the screw axially biases the first member and the at least one second member together.

16. The system of claim 15, wherein the first anti-rotational member is a plurality of downwardly extending teeth formed at an axial extent of a head portion of the first member.

17. The system of claim 16, wherein the second anti-rotational member is a plurality of upwardly extending teeth formed at an axial extent of a head portion of the at least one second member.

18. The system of claim 17, wherein the downwardly extending teeth are received within spaces formed between the upwardly extending teeth to rotational fix the first member relative to the at least one second member.

19. The system of claim 15, wherein a head portion of the first member has a maximum outer diameter which is greater than a maximum outer diameter of a body portion of the first member.

20. The system of claim 19, wherein the body portion of the first member includes a transition region and an extension region, wherein a first axial abutment surface is formed at an interface of the transition region and the extension region.

21. The system of claim 20, wherein a second axial abutment surface is formed along a bore of the second member and is configured to axially abut the first axial abutment surface.

* * * * *